US006257557B1

(12) United States Patent
Anderson et al.

(10) Patent No.: US 6,257,557 B1
(45) Date of Patent: Jul. 10, 2001

(54) SPLIT COVER SHOE FOR ENCLOSING THE BASE OF A POST

(76) Inventors: Dennis Ronald Anderson, 1952 Rainbow Ridge, Corona, CA (US) 91720; Dale Shane Anderson, 27200 Arrow Point Trail, Corona, CA (US) 91719

( * ) Notice: Subject to any disclaimer, the term of this patent is extended or adjusted under 35 U.S.C. 154(b) by 0 days.

(21) Appl. No.: 09/311,325

(22) Filed: May 13, 1999

(51) Int. Cl.[7] ..... E04H 17/00

(52) U.S. Cl. ..... 256/1; 256/65; 52/736.4

(58) Field of Search ..... 256/1, 59, 65, 256/19, 21, 22; 52/736.4, 736.3, 737.5; 248/519

(56) References Cited

U.S. PATENT DOCUMENTS

| | | | | |
|---|---|---|---|---|
| 1,517,846 | * | 12/1924 | Lewis | 52/736.4 X |
| 1,999,098 | * | 4/1935 | Hillyer et al. | 52/736.4 |
| 3,335,534 | | 8/1967 | Hester et al. . | |
| 3,915,434 | * | 10/1975 | Lister | 256/59 |
| 4,035,978 | * | 7/1977 | Bajorek et al. | 256/65 X |
| 4,244,156 | * | 1/1981 | Watts, Jr. | 52/736.4 X |
| 4,269,534 | * | 5/1981 | Ryan | 256/1 X |
| 5,029,818 | * | 7/1991 | Katz | 256/22 |
| 5,029,820 | * | 7/1991 | Katz | 256/59 |
| 5,048,229 | | 9/1991 | Campbell . | |
| 5,143,472 | * | 9/1992 | Reed et al. | 256/59 X |
| 5,340,086 | * | 8/1994 | Dorr | 256/1 X |
| 5,369,925 | | 12/1994 | Vargo . | |
| 5,685,522 | | 11/1997 | Randolph, Jr. . | |
| 5,832,675 | * | 11/1998 | Zuares | 52/736.4 X |
| 5,899,044 | * | 5/1999 | Jarrett | 52/736.3 X |
| 5,992,124 | * | 11/1999 | Robinson | 52/736.4 X |

* cited by examiner

*Primary Examiner*—Harry C. Kim
(74) *Attorney, Agent, or Firm*—Milord Keshishzadeh, Esq.; Milord & Associates

(57) ABSTRACT

A cover shoe that encloses the junction between the base of a post and a mounting plate is disclosed. The cover shoe is preferably made of two pieces and thus allows the cover shoe to be applied to the junction after the post has been welded to the mounting plate. The two piece cover shoe eliminates the need for field welding of the post to the mounting plate while the cover shoe is precariously slid up the post and maintained there during the welding process.

17 Claims, 1 Drawing Sheet

SPLIT COVER SHOE FOR ENCLOSING THE BASE OF A POST

FIELD OF THE INVENTION

This invention relates to cover shoes in ornamental iron technology and particularly to a split cover shoe used to enclose the junction between the mounting plate and the base of a post thereby eliminating the need for field welding thereof.

BACKGROUND OF THE INVENTION

Fences are used to enclose property and define the boundaries thereof. In addition, railings and banisters are provided within and around houses as a safety device to prevent individuals from falling from uneven floor levels and as an aid in climbing stairs. Furthermore, the more recent building codes require a minimal distance between the base of the post and the lowest railing that runs horizontally from one post to the next. The minimal distance therebetween prevents toddlers and small pets from slipping under the railing and falling.

Although the stricter building codes prevent injury to toddlers and small pets, it hinders installation of the unitary piece cover shoe of the prior art. As a result of the recent building codes, there is not enough room between the lowest railing and the mounting plate to allow the cover shoe to be slipped up the post far enough to allow screws or lag bolts to be driven into the mounting plate and into the floor. Usually, in the prior art, mounting plates are first attached to the floor, then a cover shoe is slipped onto a post, the post is then welded to the mounting plate while the cover shoe is precariously maintained above the welding site. After the welding is complete, the cover shoe is then lowered to enclose the junction between the mounting plate and the post. As can be ascertained from the description of the installation of the posts and mounting plates of the prior art, field welding provides a burn hazard to the installer. In addition, at the very least, field welding may cause damage to the floor of the building whereon the mounting plates are installed, and in the worst case scenario, start a fire.

The need for a cover shoe that can be affixed to the junction between a mounting plate and the base of a post, while eliminating the need for field welding, has not been addressed in the prior art. Post base covers have been addressed in the prior art which prevent water damage to the base of a wooden post as disclosed in U.S. Pat. No. 5,832,675 to Zuares. However, the post base cover of Zuares requires nailing of the cover to the post and is time consuming to install and cannot be used with metal posts. In addition, U.S. Pat. No. 5,685,522 to Randolph, Jr. discloses a wooden post base cover that prevents damage to wooden posts as a result of yard maintenance tools. However, the Randolph post cover requires nailing or screwing of the cover to the post and is time consuming to install and cannot be used with metal posts. Furthermore, U.S. Pat. No. 5,369,925 to Vargo also provides a post protector that is placed around the base of a post to prevent damage to the post. However, the protector of Vargo must be bolted to the ground and does not fully encompass the base of the post.

The prior art does not address the need for a cover shoe that can be applied to a post and mounting plate junction that eliminates the need for field welding. Therefore, there remains a long standing and continuing need for an advance in the art of cover shoes that is simpler in both design and use, is more economical, sturdy, and efficient in its construction and use, and can quickly be installed and removed from a post and mounting plate junction while eliminating the need for field welding and the dangers associated therewith.

SUMMARY OF THE INVENTION

Accordingly, it is a general object of the present invention to overcome the disadvantages of the prior art.

In particular, it is an object of the present invention to provide a device for enclosing a post and a mounting plate junction that is efficiently and easily applicable in the field.

It is another object of the present invention to provide a device for enclosing a post and a mounting plate junction that eliminates the need for field welding of the post to the mounting plate. Thereby, the cover shoe device allows the attachment of the post to the mounting plate in the shop and decreases the time necessary for installing the mounting plate and post structure in the field.

It is yet another object of the present invention to provide a cover shoe device for enclosing a post and a mounting plate junction that is economical and time saving in its construction and use.

In keeping with the principles of the present invention, a unique cover shoe device that is preferably constructed of two pieces accomplishes the aforementioned objects and advantages. However, it is to be understood that the cover shoe can be made of more than just two pieces and that the pieces may be asymmetrical. Each piece of the cover shoe has a top portion, middle portion, and a base portion, and a cavity that extends axially from the center of the top portion to through the base portion. When the two pieces of the cover shoe are joined, the cavity accommodates a mounting plate and a post extending in a perpendicular fashion therefrom. The top portion holds the post portion and the base portion holds the mounting plate frictionally to prevent upward movement of the cover shoe.

Each of the cover shoes has a first edge and a second edge, and each of the first and second edges attaches to the corresponding edge on each of the cover shoes. The attaching means is preferably comprised of a pin and hole arrangement where a pin on the first cover shoe is adapted to insert into a corresponding hole on the second cover shoe and vice versa. However, an adhesive means can also be used to attach the two pieces together. The two piece arrangement of the present cover shoe allows the cover shoe to be applied to the mounting plate and post junction without the necessity for field welding.

Such stated objects and advantages of the invention are only examples and should not be construed as limiting this invention. These and other objects, features, aspects, and advantages of the invention herein will become more apparent from the following detailed description of the embodiments of the invention when taken in conjunction with the accompanying drawings and the claims that follow.

DETAILED DESCRIPTION OF THE INVENTION

Figure 1:
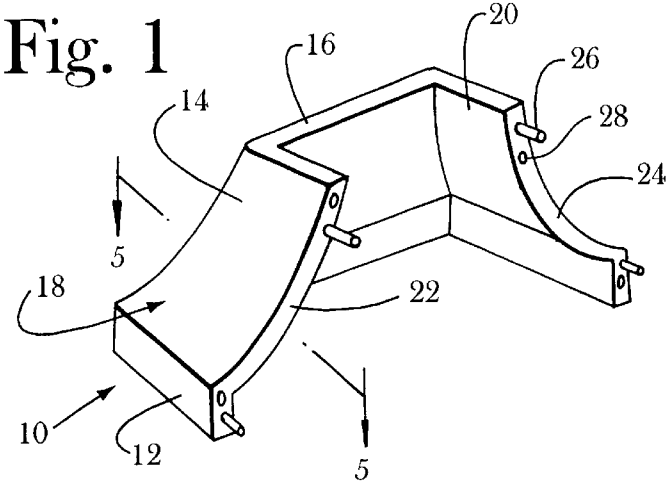
FIG. 1 is a perspective view of one half of the split cover shoe.

Referring to FIG. 1, therein is illustrated a first half of a cover shoe 10 and it is to be understood that a second half of a cover shoe 10 is preferably similar, however, it is to be understood that the two pieces may be asymmetrical. Cover shoe 10 may be made of varying sizes and shapes to enclose objects of varying sizes and shapes. In addition, cover shoe 10 may be constructed of a variety of materials such as, but not limited to plastics, resins, wood, and metal, and can be constructed from a variety of methods that is known in the art. The cover shoe 10 has a base portion 12, a middle portion 14, and a top portion 16 each portion being interconnected respectively. Cover shoe 10 has an outer surface 18 and an inner surface 20. In addition, cover shoe 10 has a first edge 22 and a second edge 24. Each of said edges 22 and 24 has at least a protrusion 26 extending therefrom in a perpendicular fashion. Each of said edges 22 and 24 defines at least a cavity 28 perpendicular thereto, and cavity 28 is adapted to removably, yet securely, receive protrusion 26 from the opposing cover shoe 10. The plurality of cavities 28 and protrusions 26, may be arranged as shown in FIG. 1 so that only one mold need be utilized to make cover shoe 10. However, the cavities 28 and protrusions 26 may also be arranged as shown in FIG. 3.

Figure 2:
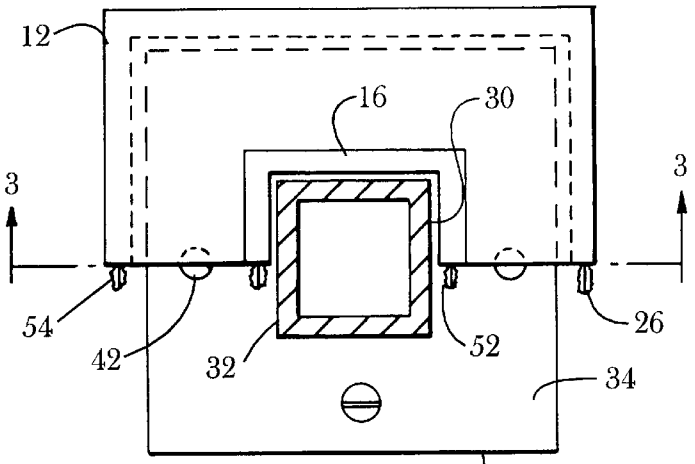
FIG. 2 is a partial top plan view illustrating one half of the split cover shoe engaging the post and the mounting plate.
Figure 3:
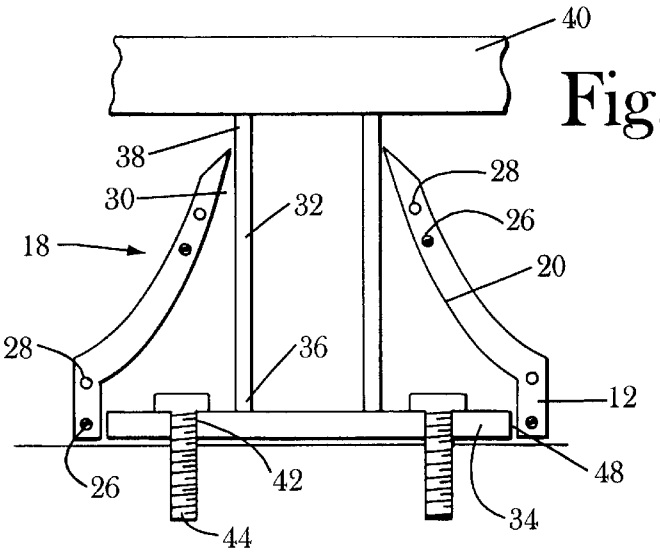
FIG. 3 is a cross sectional view taken along line 3—3 of FIG. 2 illustrating the cover shoe engaging the post and the mounting plate.

Also referring now to FIGS. 2 and 3, top portion 16 of cover shoe 10 defines a void 30 that is vertically oriented. A post 32 is received within said void 30 and enclosed by top portion 16 when the first and second cover shoe 10 are engaged. Top portion 16 may be beveled in order to deflect moisture down the outer surface 18 rather than allowing moisture to run down post 32 and the inner surface 20 of cover shoe 10. In addition, a water resistant sealant may be used to seal the gap between top portion 16 and post 32 to prevent moisture from running down post 32 and inner surface 20 of cover shoe 10. A mounting plate 34 is perpendicularly attached to a first end 36 of post 32, and a second end 38 of post 32 perpendicularly receives a railing 40. Mounting plate 34 has at least a vertically oriented aperture 42 that receives at least a binding element 44, such as, but not limited to, a screw, a bolt, or a nail. After first and second cover shoe 10 are engaged, inner surface 20 of base portion 12 frictionally engages mounting plate 34 to prohibit vertical movement of cover shoes 10. In addition, inner surface 20 of top portion 16 is adapted to frictionally engage post 32 to prevent vertical movement of cover shoes 10 after they have been installed.

Figure 4:
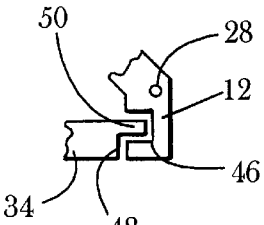
FIG. 4 is a cross sectional partial view of the mounting plate engaging the split cover shoe.

Now also referring to FIG. 4, in addition to FIGS. 1, 2, and 3, a partial cross section of base portion 12 and mounting plate 34 shows a method of engagement therebetween. Base portion 12 may have a groove 46 that runs axially along the inner surface 20 of base portion 12. An edge 48 of said mounting plate 34 may have a projection 50 that is inserted into groove 46 of base portion 12. Thereby, after the first and second cover shoe 10 are engaged to each other, projection 50 frictionally fits into groove 46 and prevents vertical movement of cover shoes 10.

Now referring to FIG. 2, protrusion 26 may have at least a laterally projecting engagement means 52, said engagement means being of sufficient size to fit into the corresponding cavity 28 and to frictionally engage edge 22 defining said cavity 28. In addition, at least a track 54 may be provided on an outer surface of protrusion 26 and running axial thereto that will permit adhesive material to be used in inserting protrusion 26 into cavity 28, thereby assuring a more secure engagement of first and second cover shoes 10.

Figure 5:
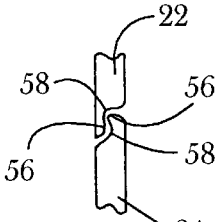
FIG. 5 is a cross sectional partial view of the split cover shoe taken along line 5—5 of FIG. 1 showing an alternate means of engagement between the two respective edges of the split cover shoe pieces.

Now also referring to FIG. 5, a partial cross section of first edge 22 of first cover shoe 10 and a corresponding second edge 24 of second cover shoe 10 is illustrated. Each of said edges 22 and 24 has a jutting portion 56 and a fossa 58. Jutting portion 56 of first edge 22 is received by fossa 58 of second edge 24, in addition, jutting portion 56 of second edge 24 is received by fossa 58 of first edge 22, thereby first and second cover shoes 10 engage one another in a secure, yet removable, fashion.

While the above description contains many specificities, these should not be construed as limitations on the scope of the invention, but rather as an exemplification of one preferred embodiment thereof. Many other variations are possible without departing from the essential spirit of this invention. Accordingly, the scope of the invention should be determined not by the embodiment illustrated, but by the appended claims and their legal equivalents.

What is claimed is:

1. In combination, a mounting plate having a fastening means to attach a support surface and a connecting means, a post extending from the mounting plate, and a cover shoe for enclosing the post and mounting plate;

the cover shoe further comprising a first piece and a second piece wherein each of the pieces has a base portion, a middle portion, a top portion, and said base, middle, and top portions of each of said pieces having a first edge and a second edge;

each of the pieces having an inner surface and an outer surface;

a groove running axially on said inner surface of said base portion, and a projection extending from an edge of said mounting plate, and said projection being adapted to fit within said groove to securely, yet removably, maintain said pieces with said mounting plate;

said first piece removably, yet securely, communicating with said second piece and enclosing said installed post and said mounting plate therebetween, and eliminating the necessity of field welding the mounting plate to the post.

2. The invention of claim 1, wherein a cavity is positioned axially and extends from said top portion through said base portion.

3. The invention of claim 2, wherein said base portion of each of said pieces frictionally engages said mounting plate positioned within said cavity.

4. The invention of claim 2, wherein said top portion of each of said pieces frictionally engages said post extending axially within said cavity.

5. The invention of claim 1, wherein an adhesive means is applied to said inner surface of said top portion and said base portion.

6. The invention of claim 1, wherein a binding means is applied to said first edge and said second edge of each of said pieces to attach said first piece to said second piece.

7. The invention of claim 6, wherein a protrusion extends from said first edge of said first piece and is insertable into a cavity defined by said first edge of said second piece to removably bind said pieces together.

8. The invention of claim 7, wherein a plurality of said protrusions and said cavities are dispersed along said edges of said pieces.

9. The invention of claim 7, wherein an adhesive means is applied to said protrusion to securely, yet removably, maintain said protrusion within said cavity defined by said edge.

10. The invention of claim 7, wherein at least a projection extends laterally from said protrusion to securely, yet removably, maintain said protrusion within said cavity defined by said edge.

11. The invention of claim 7, wherein at least a groove extends axially along a top surface of said protrusion.

12. The invention of claim 6, wherein a jutting portion and a fossa are defined by said first edge of said first piece and a jutting portion and a fossa are defined by said first edge of said second piece, and said jutting portion of said first piece engages said fossa of said second piece, and said jutting portion of said second piece engages said fossa of said first piece.

13. The invention of claim 1, wherein said pieces are adapted to accommodate a plurality of sizes of said post and said mounting plate.

14. The invention of claim 1, wherein a plurality of aesthetic designs are applicable to said outer surface.

15. The invention of claim 1, wherein said cover shoe is constructed of a material selected from the group consisting of at least a metal, wood, resin, plastic, and polymers.

16. In combination, a mounting plate having a fastening means to attach a support surface and a connecting means, a post extending from the mounting plate, and a cover shoe for enclosing the post and mounting plate;

at least a first member and a second member defining the cover shoe;

an inner surface and an outer surface existing on both said first member and second member;

a base portion, a middle portion, a top portion, a first edge and a second edge being contained on said first member and said second member respectively;

a cavity positioned axially and extending from said top portion through said base portion;

said first edge and said second edge of said first member abutting a respective first edge and second edge of said second member; and said edges having at least one male and one female binding means for binding said first member to said second member and enclosing said mounting plate and said post therebetween and eliminating the need for field welding.

17. A method of using a cover shoe to enclose a mounting plate and a post arising in a substantially perpendicular fashion therefrom, comprising the steps of:

having at least a first member and a second member defining said cover shoe;

providing an inner surface and an outer surface on each of said first member and second member;

providing a first end and a second end on each of said first member and second member;

extending a cavity axially from said first end to said second end of each of said first member and second member;

engaging said first member to said second member to maintain said post and said mounting plate within said cavity; and providing an attaching means on said mounting plate for attachment to said cover shoe.

* * * * *